US008832911B2

(12) United States Patent
Strong

(10) Patent No.: US 8,832,911 B2
(45) Date of Patent: Sep. 16, 2014

(54) HAND-HELD LACE TIGHTENING APPARATUS

(76) Inventor: James L. Strong, Indiana, PA (US)

( * ) Notice: Subject to any disclaimer, the term of this patent is extended or adjusted under 35 U.S.C. 154(b) by 242 days.

(21) Appl. No.: 13/615,706

(22) Filed: Sep. 14, 2012

(65) Prior Publication Data

US 2013/0239373 A1 Sep. 19, 2013

Related U.S. Application Data

(60) Provisional application No. 61/685,461, filed on Mar. 19, 2012.

(51) Int. Cl.
*B25B 9/00* (2006.01)

(52) U.S. Cl.
USPC ..... 24/712; 254/114; 254/124; 254/133 R; 254/384; 7/170; 81/345; 81/355; 81/407; 294/19.3; 294/16

(58) Field of Classification Search
CPC ..... B25B 9/04; B25B 7/12; B25B 9/00; B25B 3/00; B25B 5/02
USPC ..... 294/103.1; 81/345
See application file for complete search history.

(56) References Cited

U.S. PATENT DOCUMENTS 602,911 A * 4/1898 Mitchell ..... 254/28
1,313,788 A * 8/1919 Brown ..... 294/11
2,243,305 A * 5/1941 Adler ..... 294/34
2,448,384 A * 8/1948 Meinzinger ..... 188/65.1
2,454,878 A * 11/1948 Marler ..... 81/3.8
4,738,452 A 4/1988 Cohen
5,347,695 A 9/1994 Lopez Saiz
6,112,379 A 9/2000 Fernandez
6,568,103 B2 5/2003 Durocher
6,752,441 B1 * 6/2004 Morris ..... 294/12
6,913,045 B2 7/2005 Fantino et al.
7,152,285 B2 12/2006 Liao
8,181,320 B2 5/2012 Wolfberg

* cited by examiner

*Primary Examiner* — Jack W Lavinder
(74) *Attorney, Agent, or Firm* — McKay & Associates, P.C.

(57) ABSTRACT

A lace tightening apparatus including a handle and a gripping platform. The gripping platform is adapted to travel up into the interior of the handle upon a compression force being applied thereto. An anvil is rigidly attached to the handle projecting downward from the underside. One or more springs are disposed within the interior, with the first end of the spring anchored to the handle within the interior and the second end connected to the gripping portion. A stylus is attached to the gripping portion having a post and an L-shaped portion including a lip. The lip is exposed outside of the anvil and projects downward away from the anvil. Therefore, when the compression force is applied to the gripping platform, the lip travels upward toward the bottom surface of the anvil such that a lace can be pinched between the lip and the bottom surface.

9 Claims, 2 Drawing Sheets

HAND-HELD LACE TIGHTENING APPARATUS

CROSS-REFERENCE TO RELATED APPLICATIONS

The instant application claims benefit of provisional application Ser. No. 61/685,461 filed Mar. 13, 2012, the contents of which are herein incorporated by reference.

BACKGROUND

1. Field of the Invention

The instant invention relates to mechanisms for tightening the laces of shoes, skates, or other footwear. Particular, the invention is a hand-held apparatus adapted to clamp or pinch a lace along various locations to provide an upward pulling force with a mechanical advantage.

2. Description of the Related Art

Various mechanical devices are known in the art which aid in the tightening or speed-lacing of shoes or skate laces. Such devices exist because of the limited force that can be applied by hand when tightening laces, especially for footwear which demands considerable tightness, such as ice skates or snowboarding boots.

Some devices are provided directly as part of the lace or lacing system. U.S. Pat. No. 6,568,103 to Durocher teaches a speed lacing device for an article of footwear having a rigid portion comprising a curved neck and a fastening tail that together define an almost-friction-free sliding surface for a lacing cord, the lacing cord being in contact with the sliding surface in either a state of tension or a state of relaxation. U.S. Pat. No. 6,112,379 to Fernandez shows a fastener for cords including a support body, a first flexible lever arm and a second flexible lever arm. The support body has an insertion device to guide a cord onto a main surface thereof. U.S. Pat. No. 5,347,695 to Lopez Saiz describes a rapid tightening and loosening device for shoe lace, which has a small plate with a hook for insertion in the shoe eyelet and end ring for the passage of the lace.

Additional lace tightening or speed-lacing means can be provided using apparatuses which do not form part of the lacing system, rather they removably connect to or contact the lace. U.S. Pat. No. 8,181,320 to Wolfberg for example shows a shoe lace adjuster, which has inner and outer frames comprising inner and outer frame apertures to receive ends of a shoelace, respectively, and a resilient member moving inner and outer frames between unlocked and locked configurations. U.S. Pat. No. 7,152,285 to Liao teaches a shoe lace fastening device, having a rib extending from the inside of a space and located between two apertures, a positioning unit connected to the side frame via apertures, and teeth for securing the shoe lace by force of a biasing unit.

Inherent in the art is that it is undesirable to completely re-make or significantly modify the traditional shoe lacing system comprising simply a lace threaded through the eyelets or hooks of the footwear. Replacing systems which deviate from traditional laces are burdensome, expensive, and would limit the wearer to very few replacement options. Also, traditional devices for tightening laces which do not form part of the lacing system are overly-complex, expensive, and are not easy to use as they require the lace be inserted or threaded through small holes, resulting potentially in a more time-consuming process.

There is a need then for a lace-tightening device which is inexpensive, simple to use and which is used in conjunction with traditional shoe or skate laces.

SUMMARY

It is the objective of the instant invention to provide an inexpensive device which aids in the tightening of footwear laces.

It is further an objective to provide a device which does not form part of the lacing system, but rather is a separate, hand-held apparatus.

It is further an objective to provide a device which is easy to use because it does not demand the careful insertion of the lace into the apparatus.

Accordingly, what is provided is a lace tightening apparatus, including an elongate handle having an interior, a top surface, an underside, a front, and a back. A gripping platform is partially within the interior of the handle traveling most of a length of the handle along the underside. The gripping platform has a right half and a left half, with each half separated by a channel. The gripping platform is adapted to travel up into the interior of the handle upon a compression force being applied thereto. An anvil is rigidly attached to the handle projecting downward from the underside disposed within the channel and having a bottom surface most distal to the handle, the anvil traveling a width of the handle from the front to the back. Then, one or more springs are disposed within the interior, with each spring having a first end and a second end, the first end anchored to the handle within the interior and the second end movably connected to the gripping platform. A stylus is integrally attached to the gripping platform having a post and an L-shaped portion including a lip. The L-shaped portion with the lip is exposed outside of the anvil and projects downward away from the anvil. The post is contained within the anvil and has a post top rigidly attached to the gripping platform within the channel. Therefore, when the compression force is applied to the gripping platform, the lip travels upward toward the bottom surface of the anvil such that when the lip engages the lace the lace can be pinched between the lip and the bottom surface of the anvil for manipulation thereof.

DETAILED DESCRIPTION OF THE PREFERRED EMBODIMENT

Figure 1:
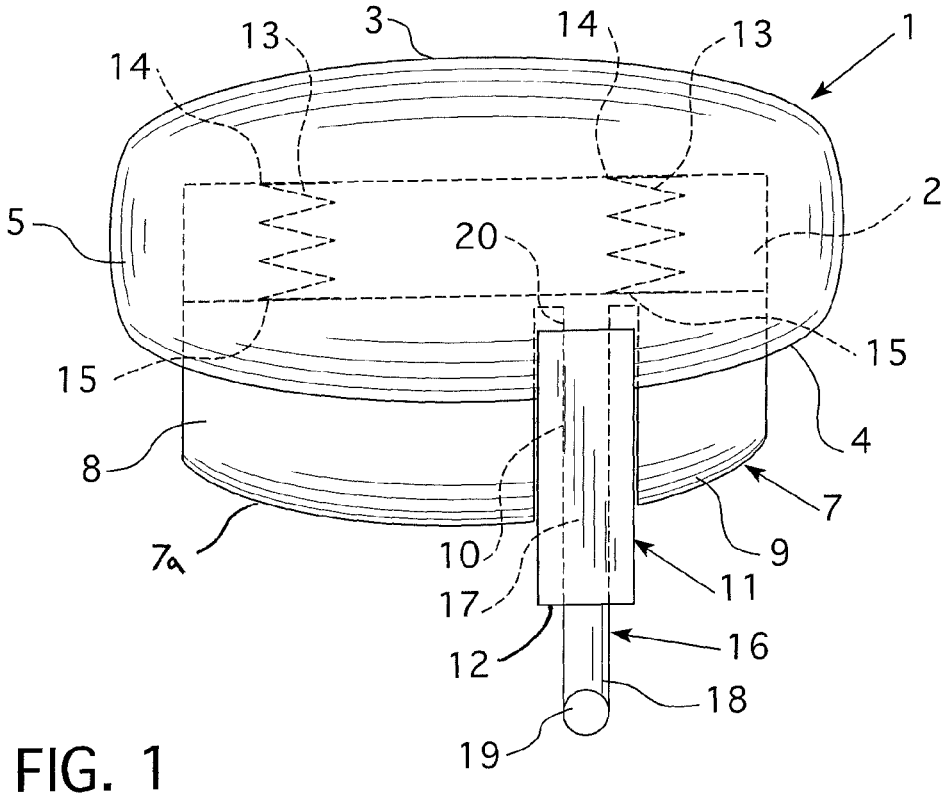
FIG. 1 shows a front elevation view of the instant apparatus.

The invention will now be described in detail in relation to a preferred embodiment and implementation thereof which is exemplary in nature and descriptively specific as disclosed. As is customary, it will be understood that no limitation of the scope of the invention is thereby intended. The invention encompasses such alterations and further modifications in the illustrated assembly, and such further applications of the principles of the invention illustrated herein, as would normally occur to persons skilled in the art to which the invention relates. This detailed description of this invention is not meant to limit the invention, but is meant to provide a detailed disclosure of the best mode of practicing the invention.

With reference then to FIGS. 1-4, shown is the lace tightening apparatus. A handle 1 has an interior 2, a top surface 3, an underside 4, a front 5, and a back 6. Although not critical, handle 1 is preferably somewhat rounded and elongate to conform to the palm of a user's hand when the user grips the handle 1.

A gripping platform 7 resides partially within the interior 2 of the handle 1, traveling most of a length of the handle 1 along the underside 4. As shown, gripping platform 7 is a generally rectangular member with a rounded bottommost portion 7*a* designed to allow a user's fingers to encompass the gripping portion at this bottommost portion 7*a*. In the preferred embodiment and although not limited thereto, the gripping platform 7 and handle 1 are made of a lightweight, rigid material such as plastic and are hollow. The gripping platform 7 also has a right half 8 and a left half 9. Each half is separated by a channel 10, and the left half 9 is preferably longer than the right half 8, the design of which allows the user's index finger to engage the right half 8 with the user's remaining fingers engaging the left half 9. It should be understood that this may vary depending on whether the apparatus is for a left-hand or a right-hand of the user. The gripping platform 7 is adapted to travel up into the interior 2 of the handle 1 upon a compression force being applied thereto. The compression force would be a force upward against the gripping platform 7 as a user's hand is squeezed, as a result the user's fingers pull the gripping platform 7 upward toward the underside 4 of the handle 1 and therefore up into the interior 2 of the handle 1 as the top of the handle 1 pushes against the user's palm.

Figure 2:
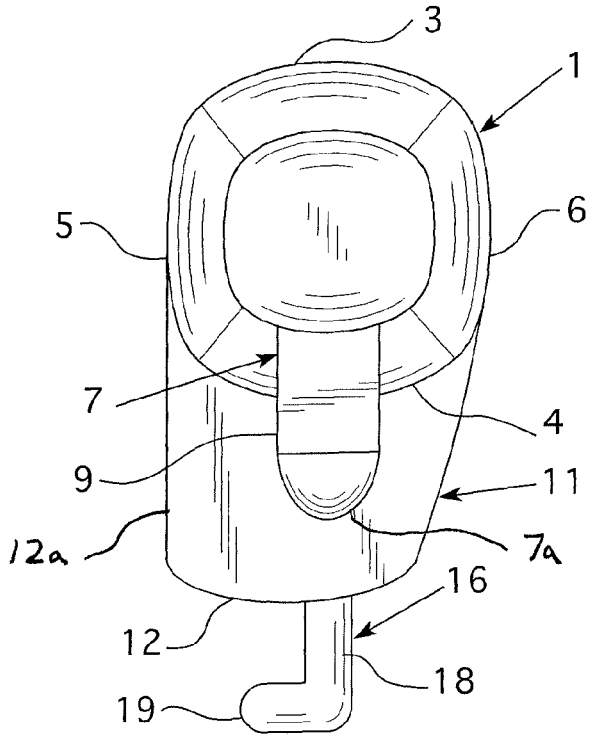
FIG. 2 shows a left side view thereof.
Figure 3:
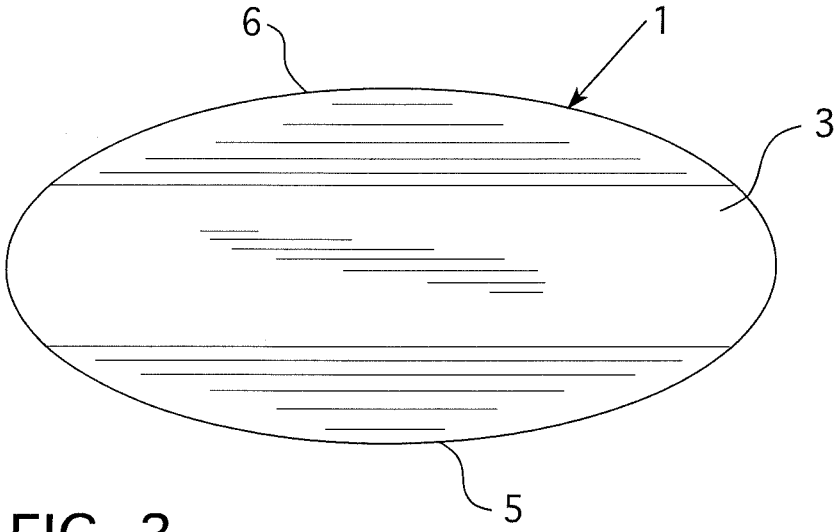
FIG. 3 shows a top plan view thereof.
Figure 4:
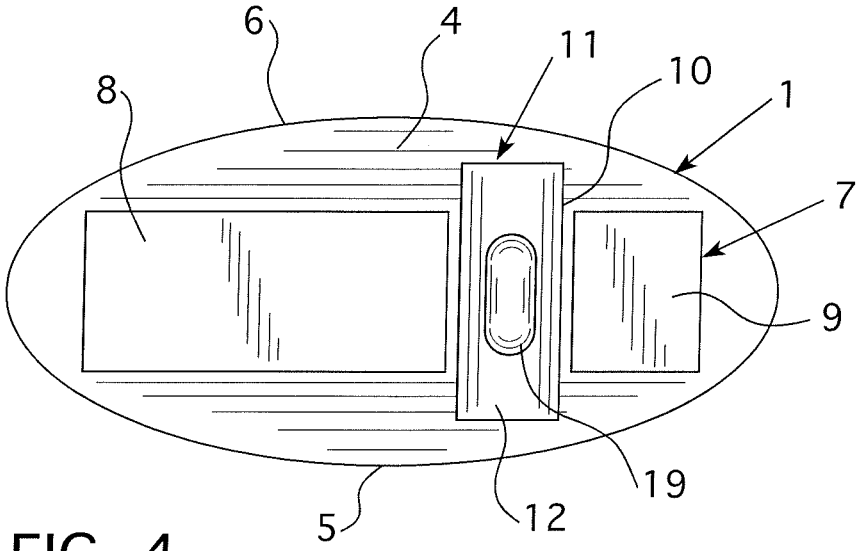
FIG. 4 shows a bottom plan view thereof.

An anvil 11 is rigidly attached to the handle 1 projecting downward from the underside 4 disposed within the channel 10 and having a bottom surface 12 most distal to the handle 1, the anvil 11 traveling a width of the handle 1 from the front 5 to the back 6 preferably. Therefore, this anvil 11 is disposed between each half of the gripping platform 7. Preferably the bottom surface 12 of anvil 11, as shown in FIG. 2, extends forward toward the front 5 of the handle 1 so as to provide a more substantial bottom surface 12 below the front face 12*a* of the anvil 11. In this manner the anvil 11 would be asymmetrical as viewed from the side.

One or more springs 13 are situated within the interior 2 of the handle 1. The springs 13 are of the coil spring type, and each spring has a first end 14 and a second end 15, the first end 14 being anchored to the handle 1 within the interior 2 as shown and the second end 15 being movably connected to the gripping platform 7. The compression force and number of springs 13 may vary but they should be such that any user may easily compress the gripping platform 7 by hand, and with two springs 13, the compression force is more evenly distributed along the entirety of gripping platform 7 and each half 8, 9.

A stylus 16 is integrally attached to the gripping platform 7. The stylus 16 is an elongate, rod member having a post 17 and an L-shaped portion 18 including a lip 19. The L-shaped portion 18 and lip 19 are those portions that are exposed outside of the anvil 11 projecting downward away from the anvil 11, the lip 19 being preferably perpendicularly attached to L-shaped portion 18 although it is envisioned the lip 19 could also take the form of a hook. The post 17 of the stylus 16 is the portion which is contained within the anvil 11. The post 17 has a post top 20 rigidly attached to the gripping platform 7 within the interior 2 of the handle 1 and within the channel 10 (and above the top of the anvil 11 as shown). Accordingly, because the stylus 16 is attached to the gripping platform 7, when the compression force is applied to the gripping platform 7, the gripping platform 7 is pulled up into the interior 2 of the handle 1 thereby also drawing up the lip 19 of the stylus 16 such that the lip 19 travels upward toward the bottom surface 12 of the anvil 11. In this manner if the lip 19 were to be engaged with a lace, the lace would be pinched between the lip 19 and the bottom surface 12 of the anvil 11.

In use therefore, footwear such as a shoe, boot, rollerblade, skate, or the like is laced in the traditional fashion, inserting the end of the lace through the typical, aligned pairs of eyelets or hooks from the toe area of the footwear up towards the end of the tongue. The footwear is placed on the user's foot. Of note is that no modification needs to be made to the footwear or the lacing system of the footwear. The user would then typically pull the ends of the untied laces by hand with as much force as possible to tighten the laces along the top of the footwear as they are pulled more snugly against the user's foot. If a preferred, snug fit is not immediately obtained, the user would typically insert his finger underneath the portions of the lace over the tongue and pull upward to further tighten the lace along the shoe, then again pull the ends. Using the instant apparatus, while the footwear is laced but still untied, the user grasps the handle 1 with the gripping portion in a relaxed state and inserts the lip 19 underneath various portions of the snug laces, in essence using the lip 19 as a substitute for his finger. The location of insertion preferably would be underneath the laced portion of the lace that resides between each pair of eyelets, e.g. the portion that crosses from one eyelet to the next, over the tongue as above. The user then squeezed the gripping platform 7 to pull the lip 19 upward, thereby clasping the lace between the lip 19 and the bottom surface 12 of the anvil 11. The lace can then be pulled using the apparatus. The resulting pulling force of the instant apparatus provides a mechanical advantage in that the entire arm and hand of the user grasping the handle 1 and compressed gripping platform 7 provides much more leverage to pull the laces upward as opposed to a finger. The resulting increased slack is then taken up by the traditional pulling of the laces at their end.

I claim:

1. A lace tightening apparatus, comprising:

a handle having an interior, a top surface, an underside, a front, and a back;

a gripping platform partially within said interior traveling most of a length of said handle along said underside, said gripping platform adapted to travel up into said interior of said handle upon a compression force being applied thereto;

one or more springs within said interior, each said spring having a first end and a second end, said first end anchored to said handle within said interior and said second end movably connected to said gripping platform;

a stylus integrally attached to said gripping platform having a post and an L-shaped portion including a lip, said post having a post top rigidly attached to said gripping platform;

wherein when said compression force is applied to said gripping platform, said lip travels upward such that when said lip engages said lace said lace is also pulled upward.

2. The lace tightening apparatus of claim 1, wherein said gripping platform includes a rounded bottommost portion.

3. The lace tightening apparatus of claim 1, wherein said gripping platform has a right half and a left half, each said right half and said left half separated by a channel.

4. The lace tightening apparatus of claim 3, wherein said left half is longer than said right half.

5. The lace tightening apparatus of claim 3, further comprising an anvil having a bottom surface and rigidly attached to said handle projecting downward from said underside.

6. The lace tightening apparatus of claim 5, wherein said anvil is disposed within said channel and has a bottom surface most distal to said handle, said anvil traveling a width of said handle from said front to said back.

7. The lace tightening apparatus of claim 6, wherein said post of said stylus is substantially contained within said anvil, and said L-shaped portion with said lip is exposed outside of said anvil and projecting downward away from said anvil such that said lip can abut said bottom surface when said lip travels upward with said lace engaged thereto to thereby pinch said lace between said lip and said bottom surface.

8. The lace tightening apparatus of claim 6, wherein said bottom surface of said anvil extends forward toward said front of said handle so as to provide a more substantial surface.

9. A lace tightening apparatus, comprising:

an elongate handle having an interior, a top surface, an underside, a front, and a back;

a gripping platform partially within said interior traveling most of a length of said handle along said underside, said gripping platform having a right half and a left half, each said right half and said left half separated by a channel, said gripping platform adapted to travel up into said interior of said handle upon a compression force being applied thereto;

an anvil rigidly attached to said handle projecting downward from said underside disposed within said channel and having a bottom surface most distal to said handle, said anvil traveling a width of said handle from said front to said back;

one or more springs within said interior, each said spring having a first end and a second end, said first end anchored to said handle within said interior and said second end movably connected to said gripping platform;

a stylus integrally attached to said gripping platform having a post and an L-shaped portion including a lip, said L-shaped portion with said lip exposed outside of said anvil and projecting downward away from said anvil, said post substantially contained within said anvil, said post having a post top rigidly attached to said gripping platform within said channel;

wherein when said compression force is applied to said gripping platform, said lip travels upward toward said bottom surface of said anvil such that when said lip engages said lace said lace can be pinched between said lip and said bottom surface of said anvil for manipulation thereof.

* * * * *